US007104284B2

(12) United States Patent
Ligneau et al.

(10) Patent No.: US 7,104,284 B2
(45) Date of Patent: Sep. 12, 2006

(54) PRESSURIZED FLUID DISTRIBUTOR

(75) Inventors: Vincent Ligneau, Mions (FR); Ludovic Veyret, Brindas (FR)

(73) Assignee: Bosch Rexroth D.S.I., Venissieux (FR)

( * ) Notice: Subject to any disclaimer, the term of this patent is extended or adjusted under 35 U.S.C. 154(b) by 0 days.

(21) Appl. No.: 10/527,021

(22) PCT Filed: Oct. 28, 2003

(86) PCT No.: PCT/FR03/03209

§ 371 (c)(1),
(2), (4) Date: Apr. 15, 2005

(87) PCT Pub. No.: WO2004/042236

PCT Pub. Date: May 21, 2004

(65) Prior Publication Data

US 2005/0247355 A1 Nov. 10, 2005

(30) Foreign Application Priority Data

Oct. 31, 2002 (FR) ..... 02 13689

(51) Int. Cl.
*F15B 13/042* (2006.01)

(52) U.S. Cl. ..... 137/636.1; 137/636.2; 91/426

(58) Field of Classification Search ..... 137/636.1, 137/636.2; 91/426
See application file for complete search history.

(56) References Cited

U.S. PATENT DOCUMENTS 5,348,049 A * 9/1994 Yonekubo et al. ..... 137/636.2
5,558,127 A * 9/1996 Maruyama et al. ..... 137/636.1
5,638,866 A 6/1997 Mueller

FOREIGN PATENT DOCUMENTS

| | | |
|---|---|---|
| FR | 2 009 201 | 1/1970 |
| FR | 2 376 978 | 8/1978 |
| FR | 2 507 732 | 12/1982 |
| FR | 2 781 846 | 2/2000 |
| WO | WO 96/30652 | 10/1996 |

* cited by examiner

*Primary Examiner*—Kevin Lee
(74) *Attorney, Agent, or Firm*—Oliff & Berridge, PLC

(57) ABSTRACT

The invention concerns a fluid distributor, in particular a hydraulic manipulator comprising a body (5), a pressure reducing valve (2) mounted in the body comprising a plunger (3) mobile in translation and whereof the displacement is controlled by a push-rod (11), a control member (6) including at least one finger (10) for modifying the position of the push-rod, means forming a solenoid (15) mounted in the body, a frame (16) adapted to be driven in translation simultaneously with the push-rod. The dispenser further comprises means for catching (20) the frame on the finger delimiting a window wherein the finger projects substantially transversely, the push-rod being mounted so as to pass right through the frame and project into the window, and the finger being interposed between the catching means and the push-rod.

10 Claims, 3 Drawing Sheets

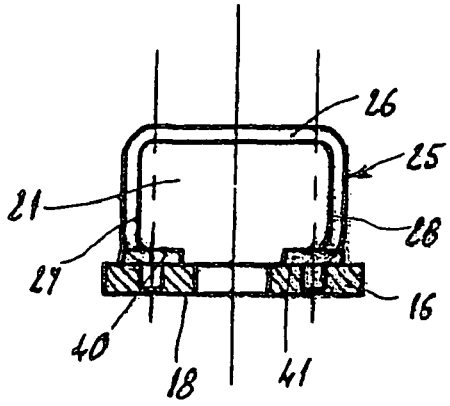
FIG 6
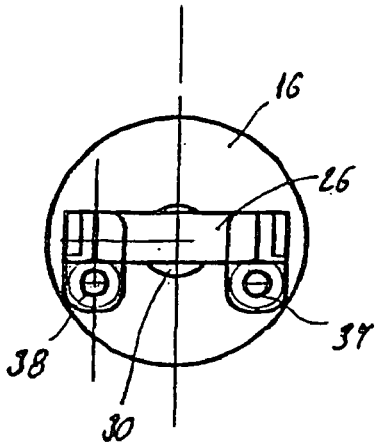
FIG 7
FIG 8
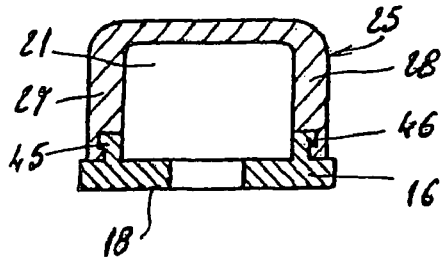
FIG 9
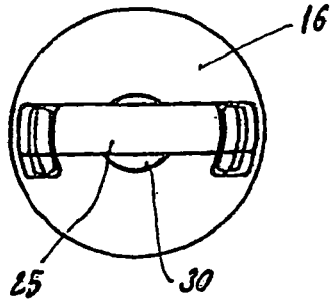

PRESSURIZED FLUID DISTRIBUTOR

BACKGROUND

The present invention relates to pressurized fluid distributors which are used to enable one or more downstream devices, operating with a pressurized fluid, to be controlled by means of a manually maneuvered member.

More particularly, the invention relates to hydraulic manipulators intended to provide control of different hydraulic functions of a public works vehicle, for example.

There is a known fluid distributor, disclosed in WO-96/30652 in particular, of the type comprising:

- a body having at least one cavity, one end of which opens on to at least one face of the body,
- at least one pressure reducing valve which is mounted in the body, and which comprises a push rod mounted movably at the level of the open end, a plunger mounted in the cavity and a control spring interposed between the push rod and the plunger, the said plunger being mounted so that it can oscillate in translation to carry out the pressure reduction function, and whose equilibrium point depends on the compression of the control spring caused by the depression of the push rod and the output control pressure to be delivered to a downstream device,
- a control member for modifying the depression of the push rod in order to control the value of the delivered pressure, the control member being mounted pivotably facing the said face of the body and comprising at least one finger,
- means forming a solenoid which can deliver a magnetic field in a direction substantially parallel to the direction of translation of the plunger, which are mounted in the body so as to be substantially coaxial with the push rod, and which form a bearing surface substantially coplanar with the said face of the body,
- an armature, made from a material sensitive to the magnetic field, which can be moved in translation simultaneously with the push rod, and which comprises a contact surface located to face the bearing surface of the means forming the solenoid, in such a way that it bears on this bearing surface to lock the push rod in position with a predetermined attractive force.

SUMMARY

In these fluid distributors, a first drawback lies in the possibility of the undesired disengagement (also called "tear-out") of the armature from the means forming the solenoid. This is because, when public works vehicles are traveling on site, a distributor mounted on such a vehicle is subjected to accelerations and decelerations which give rise to tear-out forces in the armature which exceed the attractive force exerted on the armature by the magnetic field. This is accentuated by the inertia of the control member.

A second drawback lies in the fact that the operator may not be required to perform an action with a predetermined force on the control member at the time of the tear-out. Therefore he will not know exactly when the armature has become disengaged from the solenoid.

These drawbacks are due to the fact that the armature is generally fixed rigidly to the push rod in such a way that it has no degree of freedom in rotation about horizontal axes. Consequently, in a tear-out, the armature is only in contact with the solenoid over a part of the bearing surface, so that the attractive force of the magnetic field on the armature decreases to an unknown value which is smaller than the predetermined force.

The object of the present invention is, in particular, to overcome these drawbacks by providing a fluid distributor in which the disengagement of the armature from the solenoid can only occur as a result of a force maintained at a predetermined level, this object being achieved by simple, efficient and inexpensive means.

For this purpose, according to the invention, a fluid distributor of the aforesaid type is essentially characterized in that it additionally comprises means for fastening the armature to the finger, these means delimiting a window in which the finger projects substantially transversely; in that the push rod is mounted so that it passes with a clearance into the armature and projects into the window; and in that the finger is interposed between the fastening means and the push rod.

By these arrangements, the armature is suspended under the finger of the control member, in such a way that the number of degrees of freedom of the armature is increased. Thus, when this armature is disengaged from the solenoid, it is free to shift with respect to the surrounding components, in such a way that the armature remains in contact with the whole surface of the means forming the solenoid. The magnetic attractive force exerted on the armature therefore remains at a constant predetermined level.

In a preferred embodiment, the fastening means and the armature jointly delimit the window.

Preferably, the fastening means comprise a stirrup which delimits the upper jamb and the side walls of the window, the lower jamb of the window being delimited by the armature.

It is also preferable for the finger to be in point contact with the upper jamb of the window.

In a variant, the finger has a spherical tip on which the upper jamb of the window bears.

Preferably, the armature comprises a washer made from ferrous material.

In a variant, the stirrup is overmolded on the washer.

In yet another variant, the stirrup and the armature are formed in one piece.

In yet another variant, the upper jamb and the side walls are joined to the washer by screwing.

In this case, the side walls are preferably made in the form of open channels in which screws are housed.

BRIEF DESCRIPTION OF DRAWINGS

Other characteristics and advantages of the invention will be made clear by the following description of four embodiments thereof, provided by way of example and without restrictive intent, with reference to the attached drawings, in which:

FIGS. 6 and 7 are views, similar to those of FIGS. 4 and 5, of a third embodiment of the fastening means according to the present invention.

FIGS. 8 and 9 are views, similar to those of FIGS. 4 and 5, of a fourth embodiment of the armature fastening means according to the present invention.

DETAILED DESCRIPTION OF EMBODIMENTS

Figure 1:
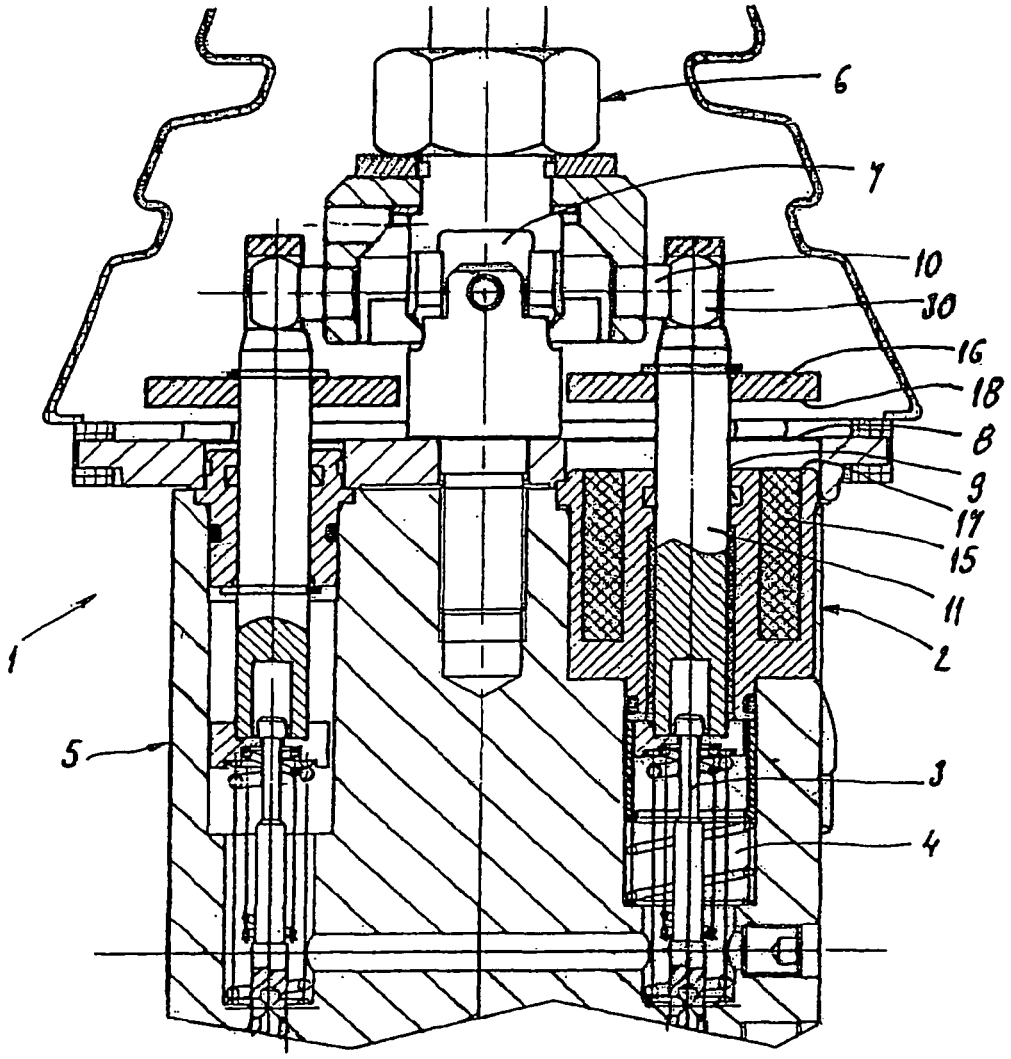
FIG. 1 is a view in partial section of a fluid distributor provided with an armature according to the present invention.

A pressurized fluid distributor, and more particularly a hydraulic manipulator, is shown in FIG. 1. The fluid is delivered to a downstream device (not shown) at a pressure which is adapted to the use which is made of it.

The pressurized fluid distributor comprises at least one pressure reducing valve 2. Preferably, as in the case of hydraulic manipulators currently used for public works vehicles, it is provided with four pressure reducing valves which are identical to each other. Only two of these pressure reducing valves are shown in FIG. 1.

Each pressure reducing valve 2 comprises a plunger 3 which can move in a cavity 4 formed in the body 5 of the distributor.

As is well known in the field, the pressure reducing valve is calibrated by an operator who acts on a control member 6 (partially shown in FIG. 1). This control member is mounted on a joint 7 which is carried by the body 5 of the distributor 1, on one of the faces 8 of the body 5. This joint is, for example, a universal type joint, a ball joint, or a pin joint.

The cavity 4 has one end 9 opening on the face 8 of the body 5. The control member 6 also has a finger 10 extending from the joint 7 to project substantially perpendicularly to the plunger 3 mounted in the cavity 4.

The pressure reducing valve comprises, in a known way, a push rod 11 and a control spring 12, in such a way that, under the action of the control member 6, the push rod 11 has a reciprocating translational motion within the cavity 4 at the open end 9 of this cavity.

Therefore the control member 6 enables the position of the push rod 11 to be modified in order to calibrate the pressure reducing valve, and thus to control the pressure delivered by the distributor to the upstream device (not shown).

The operation of such a fluid distributor is well known to those skilled in the art, and is described, for example, in FR-2 376 978, FR-2 507 732 and FR-2 781 846.

Additionally, as is also well known to those skilled in the art, the pressurized fluid distributor has means forming a solenoid 15 interacting with an armature 16 to lock the push rod 3 in a predetermined position.

The means forming a solenoid 15 consist, for example, of a coil. This coil is mounted in the body 5 substantially coaxially with the push rod 11. One end of this coil opens on the face 8 of the body 5 to form a bearing surface 17 which is substantially coplanar with this face. This bearing surface 17 can also be set back slightly from the face 8, while being substantially parallel to this face. The coil 15 thus delivers a magnetic field in a direction substantially parallel to the direction of translation of the push rod 11.

The armature 16 can be moved in translation simultaneously with the push rod 11 and is made from a material, such as a ferrous material, which is sensitive to the magnetic field. This armature has a contact surface 18 which faces the bearing surface 17, so that it bears on this bearing surface 17 in a predetermined position of the push rod 11. In this position, the push rod is thus locked with a predetermined attractive force between the armature and the coil.

According to an essential characteristic of the present invention, the fluid distributor 1 also has means 20 for fastening the armature 16 to the finger 10 of the control member 6. These fastening means enable the armature 16 to be made to move together with the finger 10, in such a way that the armature 16 is mounted by a form of suspension under the finger 10. Consequently this armature has five degrees of freedom, to keep its contact surface 18 constantly parallel to the bearing surface 17 of the coil, regardless of a possible slight misalignment between the axis of the push rod 11 and the direction of the force exerted by the finger 10 on the fastening means 20 during the movement of the push rod.

For this purpose, the fastening means 20 are located on the opposite side of the armature 16 from the face 8 of the body 5. These fastening means 20 (FIG. 2) delimit a window 21 into which the push rod 11 projects after passing through the armature 16. This push rod is mounted so that it passes through this armature with a degree of clearance.

The finger 10 is placed in the window substantially transversely with respect to it, so that it is interposed between the fastening means 20 and the push rod 11. The push rod 11 is fixed with respect to the finger 10 with regard to translation, for example by means of a circlip 22 mounted to bear on the armature 16, inside the window 21.

Figure 2:
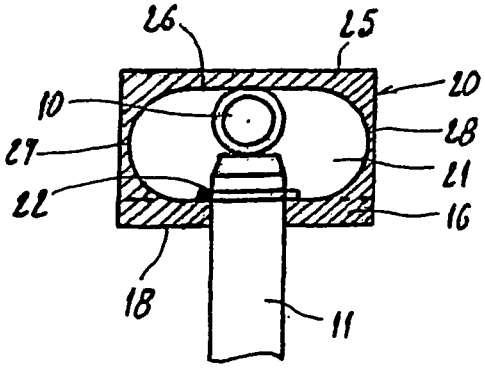
FIG. 2 is a side view, in partial section, of the armature mounted on the finger of the control member.

As shown more particularly in FIG. 2, the fastening means 20 take the form of a stirrup 25 located above the armature 16 to form the window 21 in combination with this armature. The upper jamb 26 and the side walls 27 and 28 are thus formed by the stirrup 25, while the lower jamb 29 of this window is formed by the armature 16.

To enable the armature 16 and the stirrup 25 to swing around the finger 10, the stirrup 25 is in point contact with the finger 10 at the upper jamb 26 of the window 21. The finger 10 therefore has a spherical tip 30. More particularly, this tip is hemispherical for example, so that the upper jamb 26 bears virtually with a point contact on the spherical part of the tip 30. Similarly, the push rod 11 bears on the tip 30 with a point contact, opposite the contact between the tip 30 and the upper jamb 26.

The armature 16 takes the form of a washer, for example.

Figure 3:
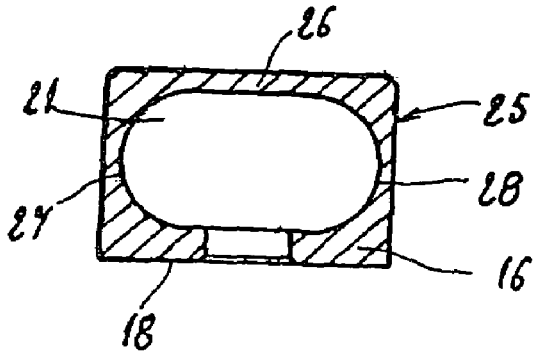
FIG. 3 is a sectional view of the armature provided with fastening means according to the present invention.

As shown more particularly in FIG. 3, the stirrup 25 and the washer 16 are formed in one piece.

Figure 4:
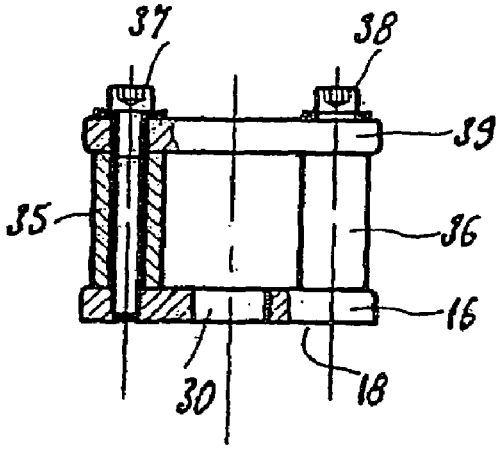
FIGS. 4 and 5 are views from the side and above of a second embodiment of the armature fastening means according to the present invention.
Figure 5:
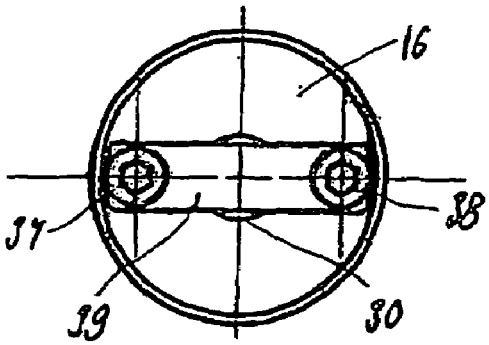

In yet another variant, the stirrup 25 is fixed to the washer 16 by screwing, as shown in FIGS. 4 and 5. In this case, the side walls 27 and 28 take the form of spacers 35 and 36 on which is placed a link 39 coinciding with the upper jamb of the window. Screws 37 and 38 pass through the spacers to fix the link and the spacers to the armature 16, substantially perpendicularly to the plane defined by this armature.

In the variant shown in FIGS. 6 and 7, the stirrup 25 is again fixed by screwing to the washer 16, as in the variant shown in FIGS. 4 and 5. The stirrup 25 is made in one piece in the form of a staple, from metal material for example. In this case it has two ends 40 and 41 which are bent back towards the inside of the window, parallel to the armature 16. These two ends are fixed by screwing to the armature.

In yet another variant shown in FIGS. 8 and 9, the stirrup 25 is fixed to the washer 16 by clipping. For this purpose, the washer has lugs 45 and 46 which project from the face of the washer 16 opposite its contact surface 18 and penetrate into the lateral walls 27 and 28. In this case, the stirrup is made from plastics material, for example.

Clearly, the invention is not limited to the examples described above, and various modifications can be made to it without departure from the scope of the present invention.

The invention claimed is:

1. A fluid distributor, particularly a hydraulic manipulator, comprising a body having at least one cavity, one end of which opens on to at least one face of the body, at least one pressure reducing valve which is mounted in the body, and which comprises a push rod mounted movably at the level of the open end, a plunger mounted in the cavity and a control spring interposed between the push rod and the plunger, the plunger being mounted so that the plunger can oscillate in translation to carry out the pressure reduction function, and with an equilibrium point depending on the compression of the control spring caused by the depression of the push rod and the output control pressure to be delivered to a downstream device, a control member for modifying the depression of the push rod in order to control the value of the delivered pressure, the control member being mounted pivotably facing the face of the body and comprising at least one finger, means for forming a solenoid which can deliver a magnetic field in a direction substantially parallel to the direction of translation of the plunger, which are mounted in the body substantially coaxially with the push rod, and which form a bearing surface substantially coplanar with the face of the body, an armature, made from a material sensitive to the magnetic field, which can be moved in translation simultaneously with the push rod, and which comprises a contact surface located to face the bearing surface of the means for forming the solenoid, in such a way that the armature bears on the bearing surface to lock the push rod in position with a predetermined attractive force, wherein the fluid distributor further comprises means for fastening the armature to the finger, the means for fastening delimiting a window into which the finger projects substantially transversely, the push rod is mounted so that the push rod passes with a clearance into the armature and projects into the window, and in the finger is interposed between the fastening means and the push rod.

2. The fluid distributor as claimed in claim 1, wherein the fastening means and the armature jointly delimit the window.

3. The fluid distributor as claimed in claim 2, wherein the fastening means comprise a stirrup which forms an upper jamb and side walls of the window, a lower jamb of the window being formed by the armature.

4. The fluid distributor as claimed in claim 3, wherein the finger is in point contact with the upper jamb of the window.

5. The fluid distributor as claimed in claim 4, wherein the finger comprises a spherical tip on which the upper jamb of the window bears.

6. The fluid distributor as claimed in claim 1, wherein the armature comprises a washer made from ferrous material.

7. The fluid distributor as claimed in claim 3, wherein the stirrup is overmolded on a washer.

8. The fluid distributor as claimed in claim 3, wherein the stirrup and the armature are made in one piece.

9. The fluid distributor as claimed in claim 3, wherein the upper jamb and the side walls are fixed to a washer by screwing.

10. The fluid distributor as claimed in claim 9, wherein the side walls are spacers through which screws pass.

* * * * *